United States Patent [19]

Asselin et al.

[11] Patent Number: 4,972,671

[45] Date of Patent: Nov. 27, 1990

[54] TURBO-ENGINE AIR INTAKE GRILL

[75] Inventors: Jean-Claude Asselin, Moret sur Loing; Pierre A. Glowacki, Fontaine le Port; Daniel J. Martin, Bombon, all of France

[73] Assignee: Societe Nationale d'Etude et de Construction de Moteurs d'Aviation "S.N.E.C.M.A.", Paris, France

[21] Appl. No.: 349,759

[22] Filed: May 10, 1989

[30] Foreign Application Priority Data

May 11, 1988 [FR] France ..... 88 06340

[51] Int. Cl.[5] ..... F02C 7/06

[52] U.S. Cl. ..... 60/39.08; 184/6.11; 415/161

[58] Field of Search ..... 60/39.08; 184/6.11; 415/161

[56] References Cited

U.S. PATENT DOCUMENTS 2,487,842 11/1949 Whiteman et al. ..... 60/39.08
2,749,087 6/1956 Blackman et al. ..... 60/39.08
3,312,448 4/1967 Hull et al. ..... 60/39.08
3,844,110 10/1974 Widlansky et al. ..... 60/39.08

FOREIGN PATENT DOCUMENTS 2526485 11/1983 France .
2599086 11/1987 France .

*Primary Examiner*—Louis J. Casaregola
*Attorney, Agent, or Firm*—Oblon, Spivak, McClelland, Maier & Neustadt

[57] ABSTRACT

An aircraft turbo-engine having an intake grille formed by radial struts disposed between inner and outer rings, each of said radial struts being in two parts, an upstream, fixed structural first part, and a downstream second part pivoted on said first part and forming an adjustable flap which constitutes an intake guide vane, all of said struts having the same cross-section as each other and at least some of the struts incorporating a pipe for the passage of oil, those oil pipe carrying struts each having its structural first part divided by a radial portion into an upstream chamber for the passage of hot air and a downstream chamber which is open along the length of its trailing edge and which receives the oil pipe.

6 Claims, 5 Drawing Sheets

TURBO-ENGINE AIR INTAKE GRILL

BACKGROUND OF THE INVENTION

1. Field of the Invention

The invention relates to aircraft turbo-engines which comprise an air intake housing with radial struts which serve as a bearing support and as intake guide vanes.

2. Summary of the Prior Art

In aero-engines, such as for supersonic aircraft for example, of which the maximum cross-section is reduced to the order of 600 to 800 mm, the thickness of the intake struts is also greatly reduced, to the order of 8.5 mm, to the extent that it has become impossible for them to house the pipes for the lubricating oil circuit of the front bearing. To allow space for these pipes, a conventional solution has been to make some of these radial struts with a thicker cross-section than the others.

This system has the disadvantage of creating intake distortions and poor annular distribution of the air flow at the entry to the compressor. Moreover, quite recently, two-part struts have been developed comprising a fixed upstream part which plays a structural role and a movable downstream part which acts as an adjustable intake guide vane. French Patent No. 2 526 485 discloses an example of this development. French Patent No. 2 599 086 discloses another example in which the oil pipes are inserted in the upstream part of the struts, of which the structure is conventional and comprises a closed aerodynamic section surrounding and defining a single internal cavity. U.S. Pat. No. 3 844 110 (or its French equivalent Patent No. 2 219 312) discloses another example of such an arrangement.

The above described construction comprising some struts of large cross-section is ill suited to this two-part strut structure in which one part is movable.

SUMMARY OF THE INVENTION

It is an object of the present invention to provide an air intake grille structure of which all the struts are of the same cross-section, and therefore are of the same thickness, but of which some struts are nevertheless capable of housing an oil pipe designed to serve the engine and principally the lubrication of the front bearing, the struts being of the two-part type comprising a fixed structural part and a movable downstream part forming an adjustable intake guide vane.

To this end, according to the invention there is provided an aircraft turbo-engine having an air intake casing and an intake grille supporting said intake casing, said intake grille comprising inner and outer rings and a plurality of radial struts disposed between said inner and outer rings, at least some of said radial struts including a pipe for the passage of oil, said radial struts each being in two parts constituted by an upstream, fixed structural first part and a downstream second part pivoted on said fixed structured first part, said second part forming an adjustable flap whereby said flaps constitute adjustable intake guide vanes, said radial struts all having the same cross-section, and said radial struts which include said oil Pipes each having said structural first part provided with at least one radial partition dividing said first part into at least one upstream chamber defining a passage for a flow of hot air and a downstream chamber for receiving one of said oil pipes, said downstream chamber being open along the length of its trailing edge.

Other characteristics of the invention will become apparent from the following description of the preferred embodiment with reference to the accompanying drawings.

DESCRIPTION OF THE PREFERRED EMBODIMENT

Figure 1:
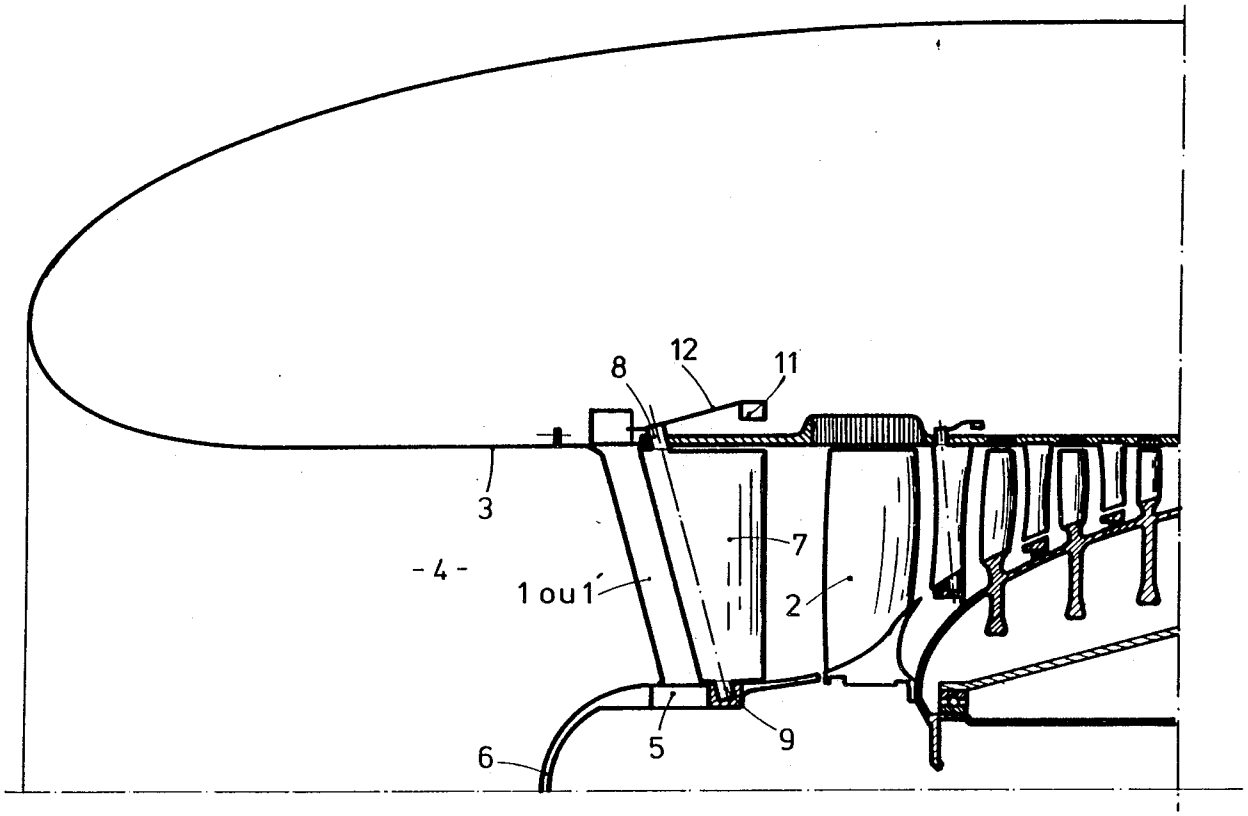
FIG. 1 is a longitudinal semi-section through the intake grille and compression stages of a turbojet engine incorporating an intake grille in accordance with the invention.

In FIG. 1, which shows the low pressure compression stages of a modern turbo-engine, for example of the type having two counter-rotating turbines, it may be seen that the intake guide vane array upstream of the first stage 2 of the low pressure compressor rotor consists of radial struts 1, 1' disposed between an outer annular part 3 of the air intake duct 4 and an inner ring 5 which is rigid with the upstream central cone 6 of the engine. The struts 1, 1' have an aerodynamic shape comprising a leading edge, an intrados and an extrados, and comprise a movable downstream part formed by a flap 7 which is turnable about an outer pivot 8 and an inner pivot 9 retained within bearing bushes 10, the rotation of the flaps 7 of all the radial struts being controlled by means of an annular control ring 11 to which they are coupled by links 12.

Figure 5:
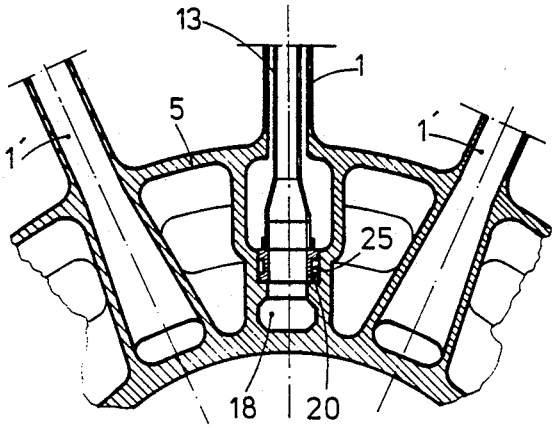
FIG. 5 is a partial radial section on line F2 of FIG. 2 showing the inner end of the oil pipe connected to the oil manifold of the inner ring of the grille.
Figure 4:
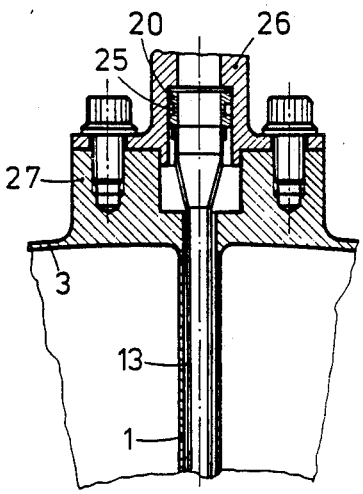
FIG. 4 is a partial radial section on line F1 of FIG. 2 showing the union between the outer end of the oil pipe of the strut and the oil circulation system of the engine.

Referring now to FIGS. 2 to 5, it may firstly be seen in FIG. 5 that between two plain struts 1' (which do not contain an oil pipe) there is a radial strut 1 which incorporates an oil pipe 13.

The struts 1, 1' are hollow to allow the circulation of hot air drawn from an air manifold 14 in order to prevent the icing up of the leading edge of the strut and the central cone 6.

The struts 1, 1' have an upstream portion, situated between the leading edge 15 and a downstream partition wall **15*a*, which forms a chamber 16, reinforced by a rib 17, for the circulation of the hot air drawn from the manifold 14. That part of the strut situated downstream of the partition wall 15*a* forms a chamber 21 which is open all along its trailing edge and which is arranged to accommodate the oil pipe 13**.

Figure 2:
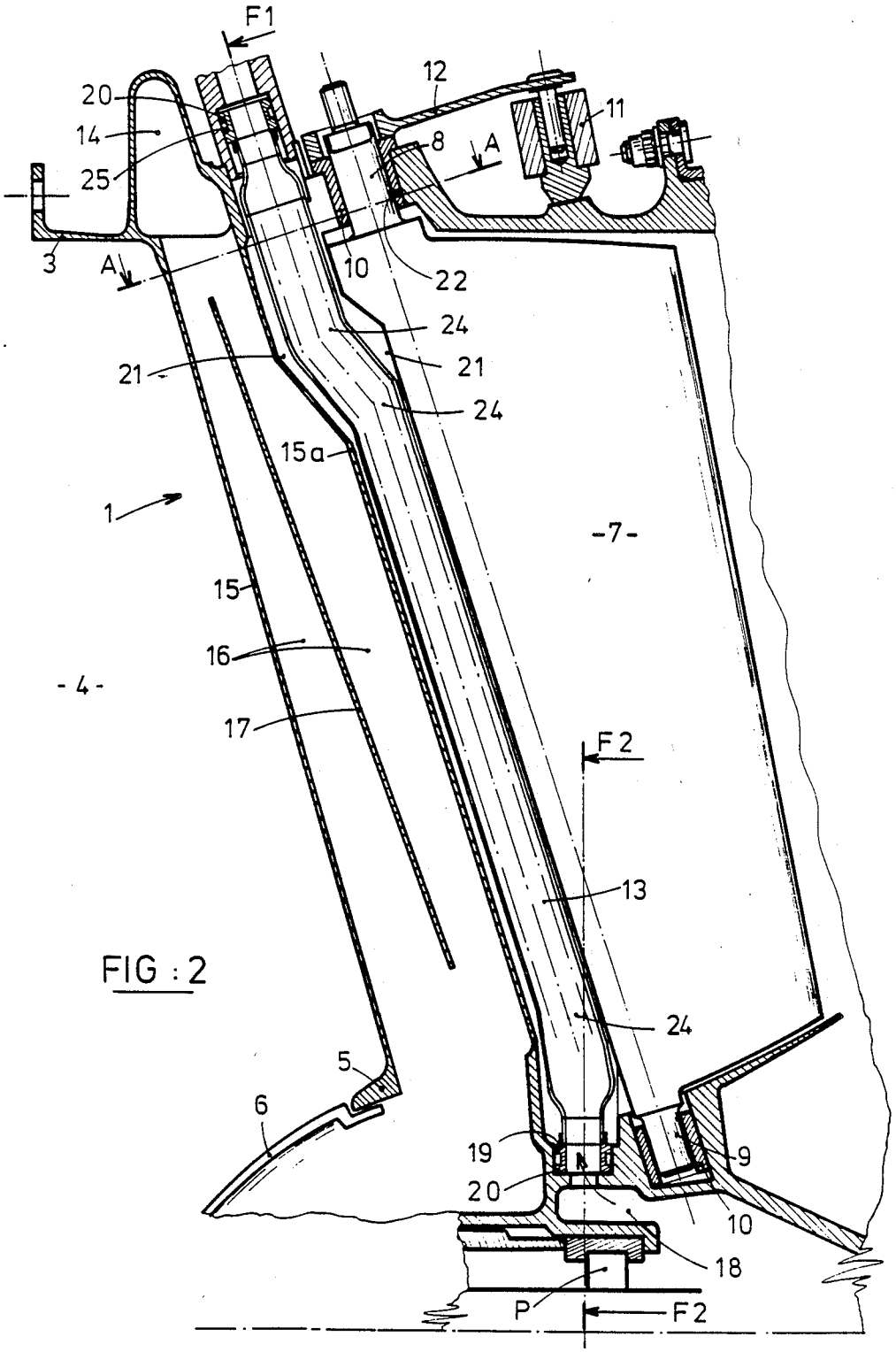
FIG. 2 is a sectional view of one of the struts of the intake grille incorporating an oil pipe.
Figure 3:
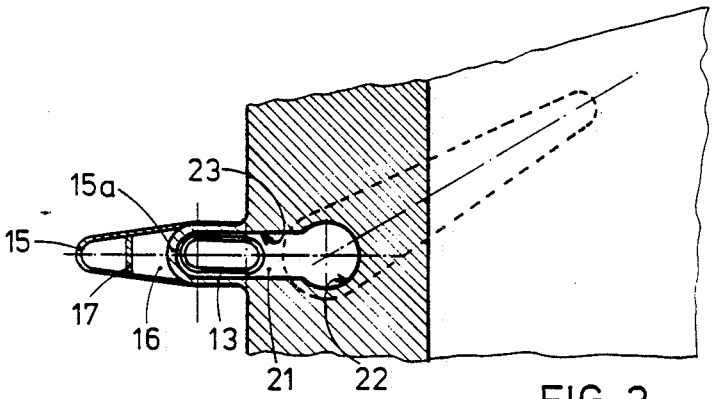
FIG. 3 is a cross-section through the radially outer portion of the strut taken along the line A—A in FIG. 2, the downstream flap of the strut having been removed.

FIG. 2 shows an example of an oil return-flow pipe arranged in accordance with the invention. The inner annular structure of the intake grille comprises a manifold 18 which collects the oil returning from the front bearing P, the said manifold opening radially in the region of each strut 1 which is fitted with an oil pipe 13 into a cylindrical seating 19 accommodating a collar 20 at the inner end of the pipe 13.

At its outer end, the downstream chamber 21 of the structural part of each strut is integral with a housing 22 for the outer pivot 8 of the downstream flap 7, and the said housing 22 is provided with a bore which receives the pivot 8 and a radial cut-out 23 communicating between the bore and the downstream chamber 21 so as to allow the oil tube 13 to be slid into the downstream chamber of the strut.

The oil tube 13 comprises a central portion of flattened, oblong section corresponding to the tapered internal shape of the chamber of the structural part of the strut which houses it, and is also cranked lengthwise in three places 24 to correspond to the cranked shape of the chamber 21. At each end of the central flattened part, the pipe is provided with a welded collar 20 which is fitted with an oil seal 25.

The outer annular member 3 of the intake grille, at each point that an oil pipe is fitted, is equipped with a removable union 26 having a bore which fits over the collar 20 at the outer end of the respective oil pipe, the said union being screwed on to a raised portion 27 of the annular member and being connected to an oil recovery pump (not shown) in the lubrication circuit of the engine.

Figure 7:
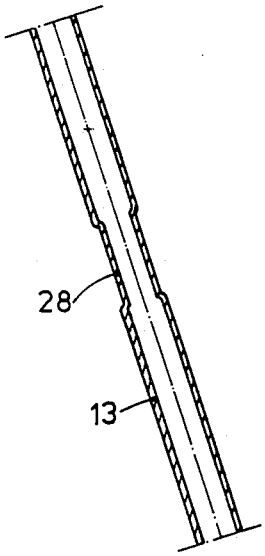
FIG. 7 is a view of the part shown in FIG. 6, looking in the direction of arrow F3.
Figure 6:
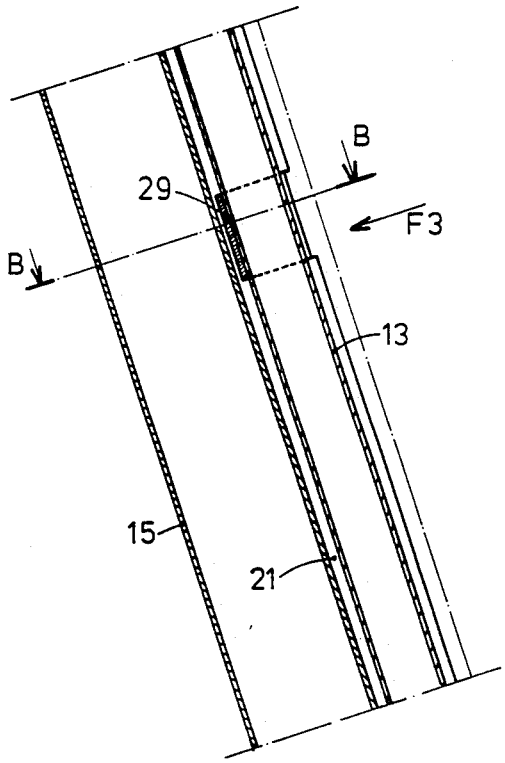
FIG. 6 is a partial longitudinal section of the central part of the strut, showing a detail of the antivibration mounting of the oil pipe in the strut.
Figure 8:
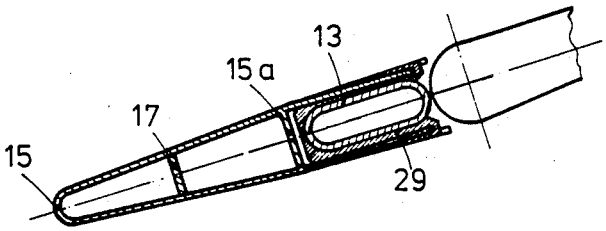
FIG. 8 is a cross-section taken on line B—B in FIG. 6.

To complete the description of the structural aspects of the embodiment illustrated, the strut 1 comprises a section of reduced width 28 (see FIGS. 6 to 8) at about the mid point of its length, designed to receive a yoke-shaped plastic clip 29 which fits on the sides of the strut in the area of the reduced width section and performs the double function of clamping the pipe 13 in the chamber 21 and of damping the vibrations to which the sides of the strut, being unsupported, could be liable.

With reference now to FIGS. 9 to 12, it can be seen how a pipe 13 is fitted into its chamber 21.

Figure 9:
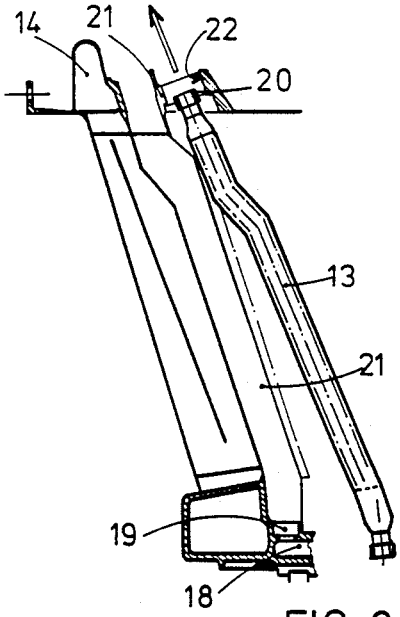
FIGS. 9 to 12 show four stages in the fitting of an oil pipe into a strut of the grille in accordance with the invention.
Figure 10:
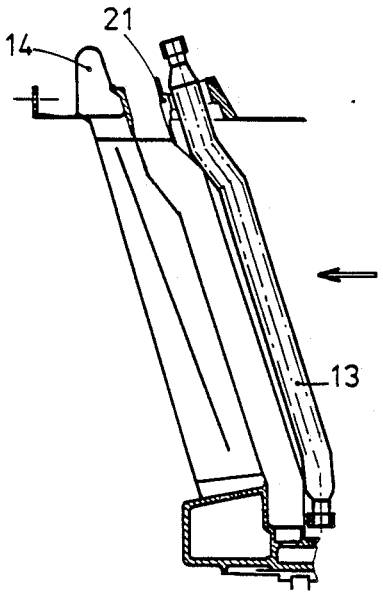
Figure 11:
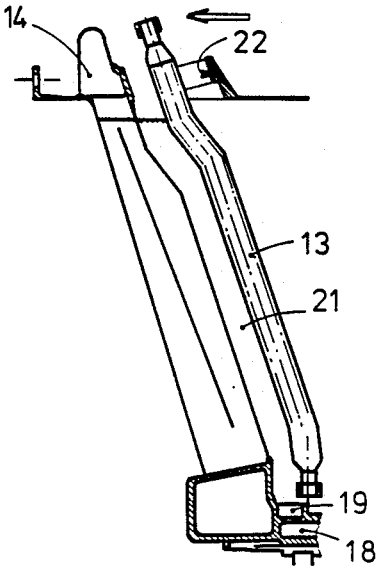
Figure 12:
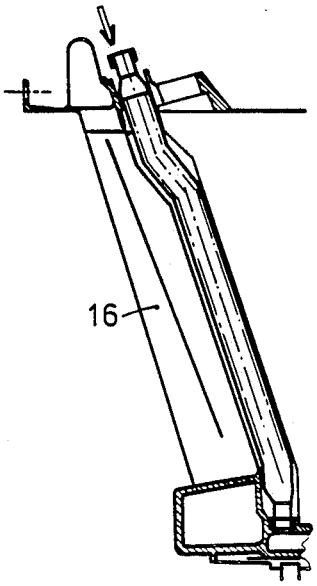

As shown in FIG. 9, the tube 13 is firstly slid into the bore in the housing 22 for the outer pivot 8 of the flap 7. Then (FIGS. 10 and 11) it is pushed upstream so that the outer end 20 of the pipe slides towards its seating through the cut-out 23 and the central part of the tube fits into the clip 29. Then, the pipe is pushed radially inwards until the inner collar 20 fits into its seating 19, and finally the removable union 26 is screwed on to the raised portion 27 of the outer ring 3 over the outer collar 20 of the pipe.

When all the oil pipes are in position within the struts 1, the flaps 7 can then be fitted in Place in a known manner.

The structure of the struts in accordance with the invention enables the intake grille to have struts which are externally identical, this constituting a notable advantage for manufacture and ensuring, in addition, the elimination of the aerodynamic peculiarities which have existed in the past.

We claim:

1. An aircraft turbo-engine having an air intake casing and an intake grille supporting said intake casing, said intake grille comprising inner and outer rings and a plurality of radial struts disposed between said inner and outer rings, at least some of said radial struts including a pipe for the passage of oil, said radial struts each being in two parts constituted by an upstream, fixed structural first part and a downstream second part pivoted on said fixed structural first part, said second part forming an adjustable flap whereby said flaps constitute adjustable intake guide vanes, said radial struts all having the same cross-section, and said radial struts which includes said oil pipes each having said structural first part provided with at least one radial partition dividing said first part into at least one upstream chamber defining a passage for a flow of hot air and a downstream chamber for receiving one of said oil pipes, said downstream chamber being open along the length of its trailing edge, wherein said inner ring of said intake grille defines an oil manifold and a plurality of cylindrical recesses for receiving the inner ends of said oil pipes, said oil manifold opening radially into said recesses.

2. A turbo-engine in accordance with claim 1, wherein each of said oil pipes has a cylindrical collar carrying a seal at each end of said pipe, said collars at the inner ends of said oil pipes cooperating with said recesses of said inner ring, and said outer ring being provided with removable unions for cooperating with the collars at the outer ends of said oil pipes.

3. A turbo-engine in accordance with claim 2, wherein each of said removable unions comprises a bore which fits over the collar at the outer end of one of said oil pipes, said union being screwed on to a raised portion of said outer ring and being connected to the oil circuit of said engine.

4. An aircraft turbo-engine having an air intake casing and an intake grille supporting said intake casing, said intake grille comprising inner and uter rings and aplurality of radial struts disposed between said inner and outer rings, at least some of said radial struts including a pipe for the passage of oil, said radial struts each being in two parts constituted by an upstream, fixed structural first part and a downstream second part pivoted on said fixed structural first part, said second part forming an adjustable flap whereby said flaps constitute adjustable intake guide vanes, said radial struts all having the same cross-section, and said radial struts which include said oil pipes each having said structural first part provided with at least one radial partition dividing said first part into at least one upstream chamber defining a passage for a flow of hot air and a downstream chamber for receiving one of said oil pipes, said downstream chamber being open along the length of its trailing edge, wherein the radially outer end of siad downstream chamber of said structural first part of each radial strut is integral with a housing for the outer pivot of siad flap part of said strut, and said housing is provided with a bore for receiving said outer pivot and a radial cut-out communicating between siad bore and said downstream chamber so as to allow one of siad oil pipes to be slid into said downstream chamber.

5. A turbo-engine according to claim 2, wherein each of said oil pipes has an oblong cross section along the length of said pipe between said cylindrical collars at the ends thereof, said oblong section corresponding to the tapered internal shape of said downstream chamber of said structural first part of said radial strut containing said oil pipe.

6. A turbo-engine according to claim 5, wherein said structural first part of said strut comprises a reduced width section and said downstream chamber of said first part is provided internally with an antivibration clip cooperating with said reduced width section for maintaining said oil pipe in position within said downstream chamber.

* * * * *

UNITED STATES PATENT AND TRADEMARK OFFICE

CERTIFICATE OF CORRECTION

PATENT NO. : 4,972,671

DATED : Nov. 27, 1990

INVENTOR(S) : Asselin et al

It is certified that error appears in the above-identified patent and that said Letters Patent is hereby corrected as shown below:

Column 2, line 44, after "intrados" insert --, an inner curve,--; same line after "extrados" insert --, an outer curve--.

Column 4, line 4, change "includes" to --include--.

Column 4, lines 30 and 31, change "uter" to --outer-- and change "aplurality" to --a plurality--.

Column 4, line 46, change "siad" to --said--.

Column 4, line 48, change "siad" to --said--.

Column 4, lines 51 and 52, change "siad" (first occurrence) to --said-- and line 52 change "siad" to --said--.

UNITED STATES PATENT AND TRADEMARK OFFICE

CERTIFICATE OF CORRECTION

PATENT NO. : 4,972,671

DATED : Nov. 27, 1990

INVENTOR(S) : Asselin et al.

It is certified that error appears in the above-identified patent and that said Letters Patent is hereby corrected as shown below:

Column 4, line 55, change "cross section" to --cross-section--.

Signed and Sealed this

Twenty-eighth Day of July, 1992

*Attest:*

DOUGLAS B. COMER

*Attesting Officer*

*Acting Commissioner of Patents and Trademarks*